US006305096B1

(12) United States Patent
Hirai et al.

(10) Patent No.: US 6,305,096 B1
(45) Date of Patent: Oct. 23, 2001

(54) PICKLING DEVICE

(75) Inventors: Etsuro Hirai; Takumi Furuya; Masato Saka; Nobuyuki Taniguchi, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/402,549

(22) PCT Filed: Mar. 5, 1999

(86) PCT No.: PCT/JP99/01060

§ 371 Date: Oct. 6, 1999

§ 102(e) Date: Oct. 6, 1999

(87) PCT Pub. No.: WO99/46427

PCT Pub. Date: Sep. 16, 1999

(30) Foreign Application Priority Data

Mar. 11, 1998 (JP) ..... 10-059307

(51) Int. Cl.[7] ..... B08B 3/04

(52) U.S. Cl. ..... 34/64 R; 134/122 R; 134/199; 134/198

(58) Field of Search ..... 134/64 R, 122 R, 134/199, 198, 201, 64 P, 122 P, 133

(56) References Cited

U.S. PATENT DOCUMENTS

| | | | |
|---|---|---|---|
| 3,097,971 | * | 7/1963 | Carlisle et al. . |
| 3,885,581 | * | 5/1975 | Dahan et al. . |
| 4,361,444 | * | 11/1982 | McClanahan et al. . |
| 4,807,653 | * | 2/1989 | Cipriano et al. . |
| 5,116,447 | * | 5/1992 | Kimura et al. . |
| 5,179,967 | * | 1/1993 | Mattiussi . |
| 5,395,702 | * | 3/1995 | Carey et al. . |
| 5,566,694 | * | 10/1996 | Pugh et al. . |
| 5,614,264 | * | 3/1997 | Himes . |
| 5,716,455 | * | 2/1998 | Zednicek et al. . |

FOREIGN PATENT DOCUMENTS

| | | | | |
|---|---|---|---|---|
| 3229338 | | 2/1984 | (DE) . | |
| 0058216A | | 8/1982 | (EP) . | |
| 0795629A1 | | 9/1997 | (EP) . | |
| 2709079A | | 2/1995 | (FR) . | |
| 2031036A | | 4/1980 | (GB) . | |
| 2031036 | * | 4/1980 | (GB) . | |
| 2111084 | * | 6/1983 | (GB) | 134/122 R |
| 2117006A | | 10/1983 | (GB) . | |
| 61-295331 | * | 12/1986 | (JP) | 134/122 R |
| 578870 | | 3/1993 | (JP) . | |
| 655213 | | 3/1994 | (JP) . | |
| 08176868A | | 7/1996 | (JP) . | |
| B2 2620866 | | 4/1997 | (JP) . | |
| 8801657 | | 3/1988 | (WO) . | |

* cited by examiner

*Primary Examiner*—Frankie L. Stinson

(57) ABSTRACT

An acid pickling tank body 11 is partitioned with a partition wall 12 into a first tank 13 and a second tank 14. The first tank 13 and the second tank 14 are filled with acid liquids $L_1$ and $L_2$, respectively, of different concentrations. A lid 15 is attached to the top of the acid pickling tank body 11. On the lid 15, immersion guide rolls 25*a* to 25*d*, 26*a* to 26*d* are mounted. On the bottom surface of the first tank 13 and the second tank 14, skids 31*a* to 31*e*, 32*a* to 32*d* are mounted via support blocks 27*a* to 27*e*, 28*a* to 28*d*. A liquid seal 22 is provided which has a cushion nozzle 38 for jetting the acid liquids $L_1$ and $L_2$ toward the surface of a strip steel plate S. traveling above the partition wall 12 for the first tank 13 and the second tank 14.

10 Claims, 8 Drawing Sheets

Acid pickling device of first embodiment

Acid pickling device of second embodiment

Conventional acid pickling device

PICKLING DEVICE

This application is the national phase under 35 U.S.C. § 371 of PCT International Application No. PCT/JP99/01060 which has an International filing date of Mar. 5, 1999, which designated the United States of America.

TECHNICAL FIELD

This invention relates to an acid pickling device for washing and removing oxide scale, formed on the surface of a strip plate, by acid pickling.

BACKGROUND ART

In removing oxide scale formed on the surface of a strip steel plate, common practice is to guide this strip steel plate into an acid pickling tank filled with an acid liquid by a guide roll, and cause the strip steel plate to travel in the acid liquid, thereby washing and removing the oxide scale on the surface by means of the acid liquid. For this purpose, an acid pickling device is available which comprises two or more acid pickling tanks connected together, the acid pickling tanks being filled with an acid liquid of different acid concentrations, and in which a strip steel plate is caused to travel in the acid pickling tanks sequentially to remove oxide scale on the surface of the strip steel plate reliably.

FIG. 8 is a schematic side view of a conventional acid pickling device.

In the conventional acid pickling device, as shown in FIG. 8, an acid pickling tank body 101 is partitioned with a partition wall 102 into a first tank 103 and a second tank 104, and the first tank 103 and the second tank 104 are almost the same in constitution. That is, the first tank 103 and the second tank 104 are open upwards, and they are filled with acid liquids $L_1$ and $L_2$, respectively, of different concentrations for acid pickling of a strip steel plate S. A lid 105 is attached to the top of the acid pickling tank body 101 to form an inlet portion 106 in the first tank 103, and an outlet portion 107 in the second tank 104. To the inlet portion 106, an aerial deflector roll 108 and an immersion deflector roll 109 are attached. To the outlet portion 107, an aerial deflector roll 110 and an immersion deflector roll 111 are attached. To an intermediate portion, an aerial deflector roll 112 and immersion deflector rolls 113 are attached.

From a lower surface of the lid 105, ceiling plates 115, 116 are suspended via engagingly stopping portions 114 for immersion in the first tank 103 and the second tank 104, respectively. From the ceiling plates 115, 116, bottom plates 117, 118 are suspended via connecting plates (not shown) located at both side parts. On the lower surface of the ceiling plates 115, 116, many immersion guide rolls 119, 120 rotatable via bearing portions are mounted along a direction of travel of the strip steel plate S. On the upper surface of the bottom plates 117, 118, many skids 121, 122 are attached at positions opposed to the immersion guide rolls 119, 120.

Thus, the strip steel plate S is guided by the aerial deflector roll 108 and the immersion deflector roll 109 at the inlet portion 106 into the acid liquid $L_1$ of the first tank 103, and travels, while being guided, between the immersion guide rolls 119 and the skids 121. At this time, oxide scale formed on the surface of the strip steel plate S is washed with the acid liquid $L_1$ and removed thereby. Then, the strip steel plate S is guided by the aerial deflector roll 112 and the immersion deflector roll 113 to pass over the partition wall 102 and come into the acid liquid $L_2$ of the second tank 104. Then, the strip steel plate S travels, while being guided, between the immersion guide rolls 120 and the skids 122.

On this occasion, the oxide scale formed on the surface of the strip steel plate S is washed with the acid liquid $L_2$ and removed thereby. Then, the strip steel plate S is guided by the immersion deflector roll 111 and the aerial deflector roll 110 at the outlet portion 107, and delivered outside of the second tank 104.

Such a conventional acid pickling device is disclosed, for example, in Japanese Unexamined Patent Publication No. 5-78870.

With the foregoing conventional acid pickling device, the acid pickling tank body 101 is divided into the first tank 103 and the second tank 104 by the partition wall 102 so that the acid liquids $L_1$ and $L_2$ do not mix. Because of this configuration, when the strip steel plate S moves from the first tank 103 to the second tank 104, the strip steel plate S is guided, in a bent shape, by the aerial deflector roll 112 and the immersion deflector rolls 113. This plate S is once pushed out of the first tank 103, and then entered into the second tank 104. At this time, a great bending stress acts on the strip steel plate S, increasing the tension of the strip steel plate S in the entire acid pickling device, and consuming a high operating power.

Furthermore, when the strip steel plate S moves from the first tank 103 to the second tank 104, it is guided by the aerial deflector roll 112 and the immersion deflector rolls 113. Thus, these rolls 112, 113 inevitably contact the acid liquid $L_1$. This requires their constant mounting and dismounting for maintenance, increasing the running cost.

The present invention has been accomplished in an attempt to solve the above problems. Its object is to provide an acid pickling device of a decreased cost, and with an increased efficiency of acid pickling treatment for a strip plate.

DISCLOSURE OF THE INVENTION

The present invention is an acid pickling device for acid pickling a strip plate by causing the strip plate to travel in an acid pickling tank filled with an acid liquid while guiding the strip plate by an immersion guide roll and a skid, wherein two or more of the acid pickling tanks are adjacent to each other via a border site, and a liquid seal is provided at the border site, the liquid seal having a cushion nozzle for jetting the acid liquid in the acid pickling tanks toward a surface of the strip plate traveling in the acid pickling tanks.

Thus, the strip plate can be supported in a straight form between the plural acid pickling tanks, and a great bending stress does not act on the strip plate. As a result, the tension of the strip plate in the entire device can be decreased, and an increase in the operating power can be prevented. Besides, no rolls are present between the adjacent acid pickling tanks. Maintenance of such rolls becomes unnecessary, and the running cost can be reduced. Consequently, the cost of the device can be decreased, and the efficiency of acid pickling for the strip plate can be increased.

The present invention also concerns the acid pickling device, wherein at the border site, a partition wall is provided below the strip plate traveling in the acid pickling tanks; a fixed skid is provided on top of the partition wall at nearly the same height as the height of the skid; and the cushion nozzle is provided above the strip plate traveling in the acid pickling tanks.

As noted above, a plurality of acid pickling tanks are formed by partitioning one acid pickling tank body with the partition wall, and the fixed skid and the cushion nozzle are provided above the partition wall. Thus, the acid pickling tanks for acid pickling the strip plate while supporting it easily in a straight form can be formed.

The present invention also concerns the acid pickling device, wherein at the border site, a partition wall is provided below the strip plate traveling in the acid pickling tanks; a lower cushion nozzle is provided on top of the partition wall; and an upper cushion nozzle is provided above the strip plate traveling in the acid pickling tanks.

Thus, the acid liquid is jetted through the cushion nozzles toward an upper surface and a lower surface of the strip plate traveling in the acid pickling tanks. As a result, the acid liquids in the adjacent acid pickling tanks do not mix, and liquid sealing can be achieved reliably.

The present invention also concerns the acid pickling device, wherein the cushion nozzle has a first jetting nozzle for jetting the acid liquid in one of the adjacent acid pickling tanks, and a second jetting nozzle for jetting the acid liquid in the other acid pickling tank.

Thus, the acid liquid jetted from the first jetting nozzle collides with the surface of the strip plate, and then flows into one of the acid pickling tanks, while the acid liquid jetted from the second jetting nozzle collides with the surface of the strip plate, and then flows into the other acid pickling tank. Hence, the acid liquids in the acid pickling tanks do not mix with each other.

The present invention also concerns the acid pickling device, wherein the first jetting nozzle and the second jetting nozzle are located in directions in which a first jet of the acid liquid and a second jet of the acid liquid jetted from the jetting nozzles collide with each other.

As noted above, the first jet of the acid liquid and the second jet of the acid liquid jetted from the jetting nozzles collide with the surface of the strip plate, and also collide with each other. Thus, the first jet and the second jet flow into their respective acid pickling tanks without mixing with each other.

The present invention also concerns the acid pickling device, wherein the cushion nozzle is provided at nearly the same height as the height of the immersion guide roll or the skid.

Thus, the strip plate can be transported satisfactorily while being supported in a straight form between the plural acid pickling tanks, without a great bending stress acting on the strip plate.

The present invention also concerns the acid pickling device, wherein an acid pickling tank lid for covering the top of the acid pickling tanks is disposed such that a central part of the lid is positioned below the liquid level of the acid liquid in the acid pickling tanks to cover a free surface of the acid liquid.

Thus, the surface area of the acid liquid in the acid pickling tanks becomes narrower than in the earlier technology. Hence, a loss of an acid due to evaporation is decreased to ensure the reliable washing and removal of oxide scale on the strip plate by acid pickling.

The present invention also concerns the acid pickling device, wherein the acid pickling tank lid is provided with the immersion guide roll and the cushion nozzle, and the skid is provided on a support block installed at a bottom of the acid pickling tank.

Thus, the immersion guide roll, the cushion nozzle, and the skid can be easily installed.

The present invention also concerns the acid pickling device, wherein the acid pickling tank lid is provided with the immersion guide roll and an upper cushion nozzle, and the skid and a lower cushion nozzle are provided on a support block installed at a bottom of the acid pickling tank.

Thus, the immersion guide roll, the upper and lower cushion nozzles, and the skid can be easily installed.

The present invention also concerns the acid pickling device, wherein supply pipes from the respective acid pickling tanks are connected to the cushion nozzle, and a liquid pump and a flow control valve are mounted on each of the supply pipes.

Thus, the acid liquid can be fed from the acid pickling tanks to the cushion nozzle by the liquid pumps via the supply pipes. In this case, the jet flow rate of the acid liquid from the cushion nozzle is adjusted by the flow control valve, whereby an appropriate amount of the acid liquid is jetted for reliable liquid sealing.

BEST MODE FOR CARRYING OUT THE INVENTION

A first embodiment of the present invention will now be described in detail by reference to the accompanying drawings.

Figure 1:
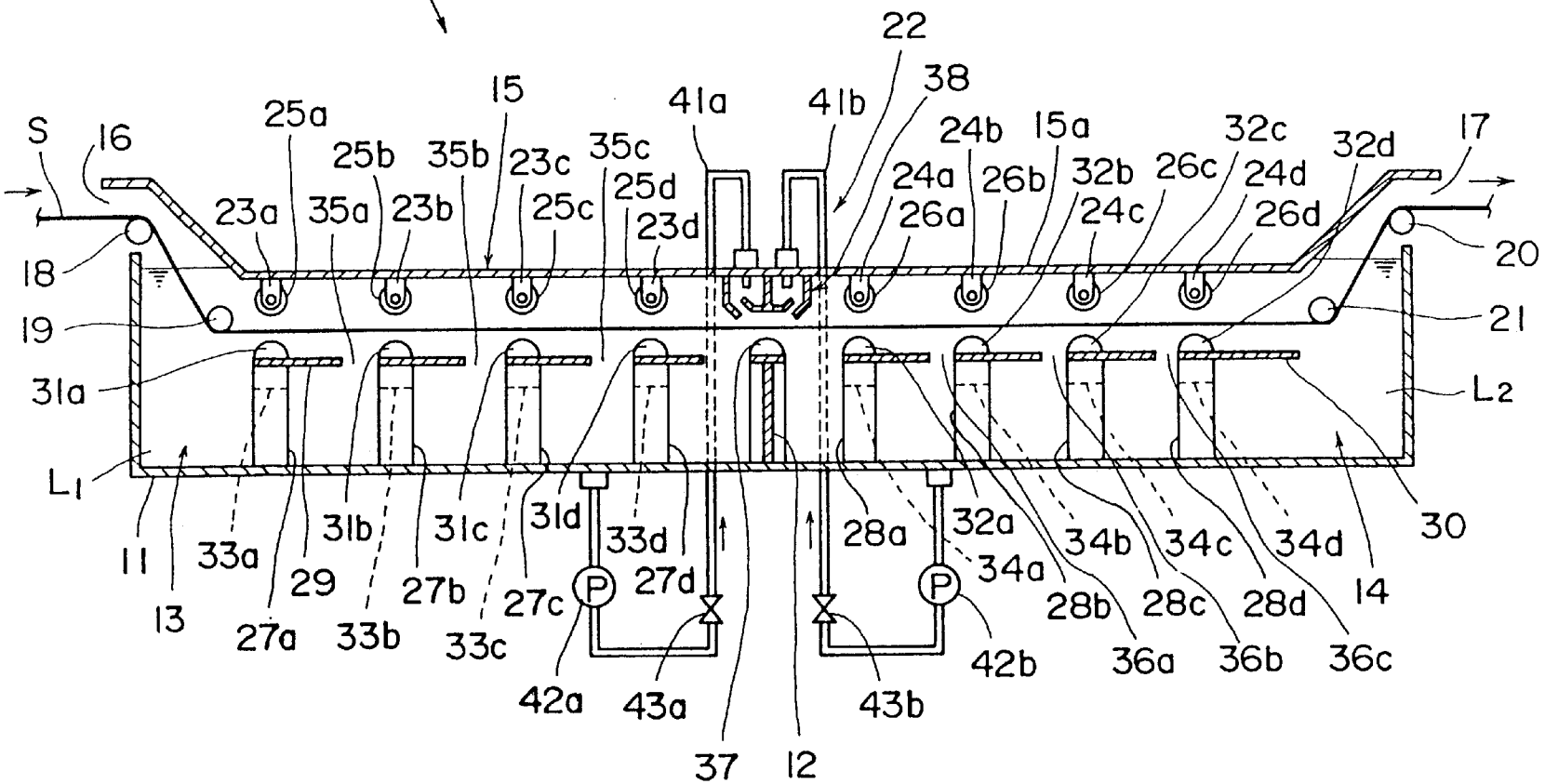
FIG. 1 is a schematic side view of an acid pickling device according to a first embodiment of the present invention.

In an acid pickling device of the present embodiment, as shown in FIG. 1, an acid pickling tank body 11 is partitioned with a partition wall 12 into a first tank 13 and a second tank 14, and the first tank 13 and the second tank 14 are almost the same in constitution. That is, the first tank 13 and the second tank 14 are open upwards, and they are filled with acid liquids $L_1$ and $L_2$, respectively, of different concentrations for acid pickling of a strip steel plate S. A lid 15 is attached to the top of the acid pickling tank body 11 to form an inlet portion 16 in the first tank 13, and an outlet portion 17 in the second tank 14. The lid 15 has an outer peripheral part fitted liquid-tight to a receiver portion of the acid pickling tank body 11, and has a central part forming a covering portion 15*a* which is concave downwardly. The covering portion 15*a* enters the acid liquids $L_1$ and $L_2$ of the first tank 13 and the second tank 14, and lies below the liquid level of these acid liquids.

To the inlet portion 16, an aerial deflector roll 18 and an immersion deflector roll 19 are attached. To the outlet portion 17, an aerial deflector roll 20 and an immersion deflector roll 21 are attached. Between the first tank 13 and the second tank 14, a liquid seal 22 is provided for inhibiting the mixing of the acid liquids $L_1$ and $L_2$. Thus, the acid liquids $L_1$ and $L_2$ of the first tank 13 and the second tank 14 in the acid pickling tank body 11 have most of their free surface covered with the covering portion 15*a* of the lid 15. The mixing of the acid liquids $L_1$ and $L_2$ is inhibited by the liquid seal 22.

Figure 2:
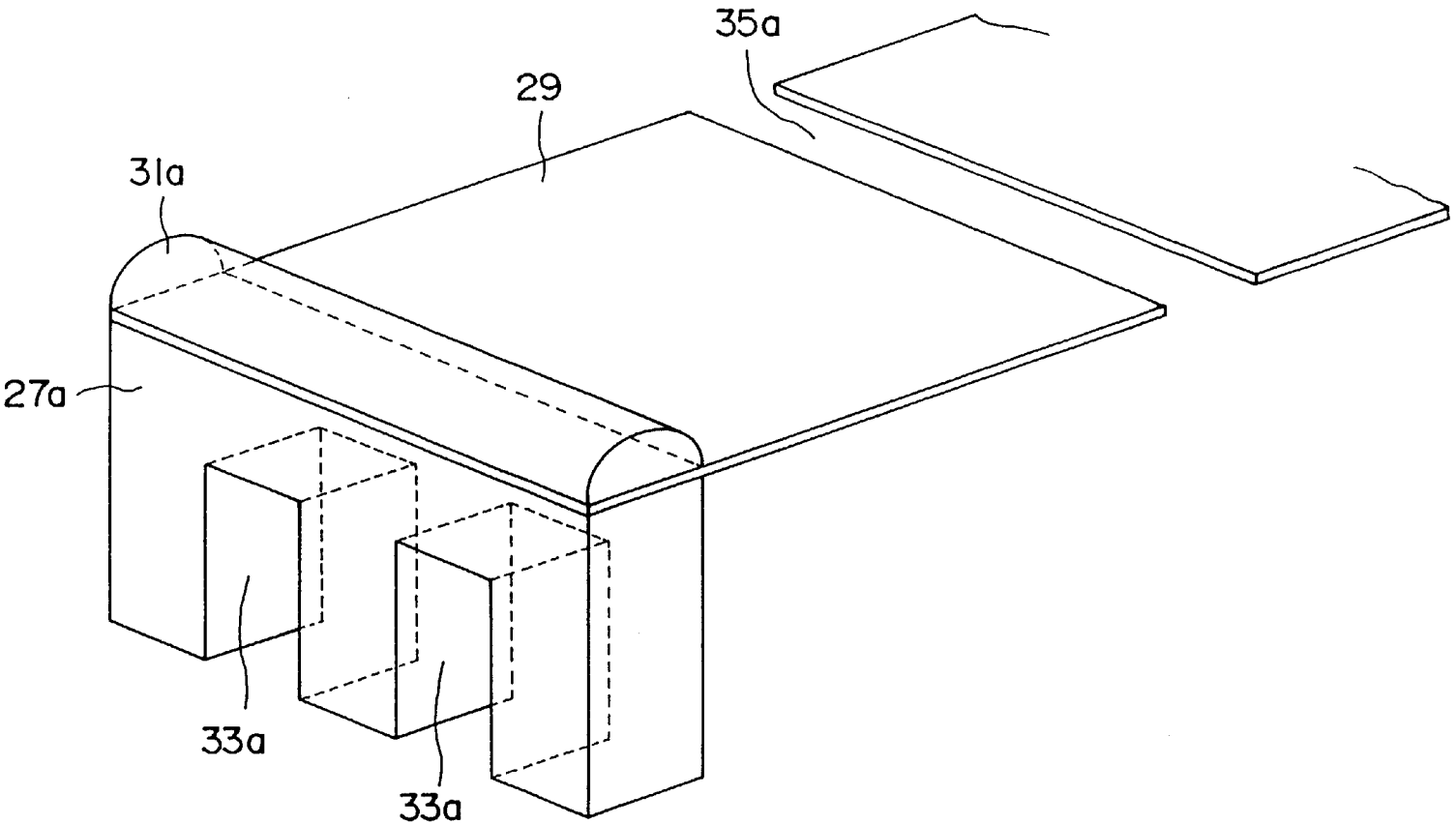
FIG. 2 is a perspective view showing a support structure for a skid.

As shown in FIGS. 1 and 2, on a lower surface of the covering portion 15*a* of the lid 15, immersion guide rolls 25*a* to 25*d*, 26*a* to 26*d*, which are immersed in the first tank 13 and the second tank 14, are rotatably mounted by a pair of (i.e., right and left) bearing portions 23*a* to 23*d*, 24*a* to 23*d* made of a metal (or resin, carbon or ceramic). This plurality of immersion guide rolls 25*a* to 25*d*, 26*a* to 26*d* are arranged parallel, with predetermined spacing, along a direction of travel of the strip steel plate S. On a bottom surface of each of the first tank 13 and the second tank 14, a plurality of support blocks 27*a* to 27*d*, 28*a* to 28*d* are arranged parallel along the direction of travel of the strip steel plate S. To the top of the support blocks 27*a* to 27*d*, 28*a* to 28*d*, bottom plates 29, 30 are fixed so as to connect the support blocks 27*a* to 27*d*, 28*a* to 28*d* together. To an upper surface of the bottom plates 29, 30, a plurality of skids 31*a* to 31*d*, 32*a* to 32*d* are fixed at positions opposed to the immersion guide rolls 25*a* to 25*d*, 26*a* to 26*d*.

In the support blocks 27*a* to 27*d*, 28*a* to 28*d*, acid liquid communication holes 33*a* to 33*d*, 34*a* to 34*d*, through which the acid liquid L can flow, are formed. In the bottom plates 29, 30, acid liquid passages 35*a* to 35*c*, 36*a* to 36*c*, through which the acid liquids $L_1$, $L_2$ can flow, are formed between the adjacent two of the skids 31*a* to 31*d*, 32*a* to 32*d* downstream in the direction of transport of the strip steel plate S. These acid liquid passages 35*a* to 35*c*, 36*a* to 36*c* are each in a slit, circular, or rectangular shape.

Figure 3:
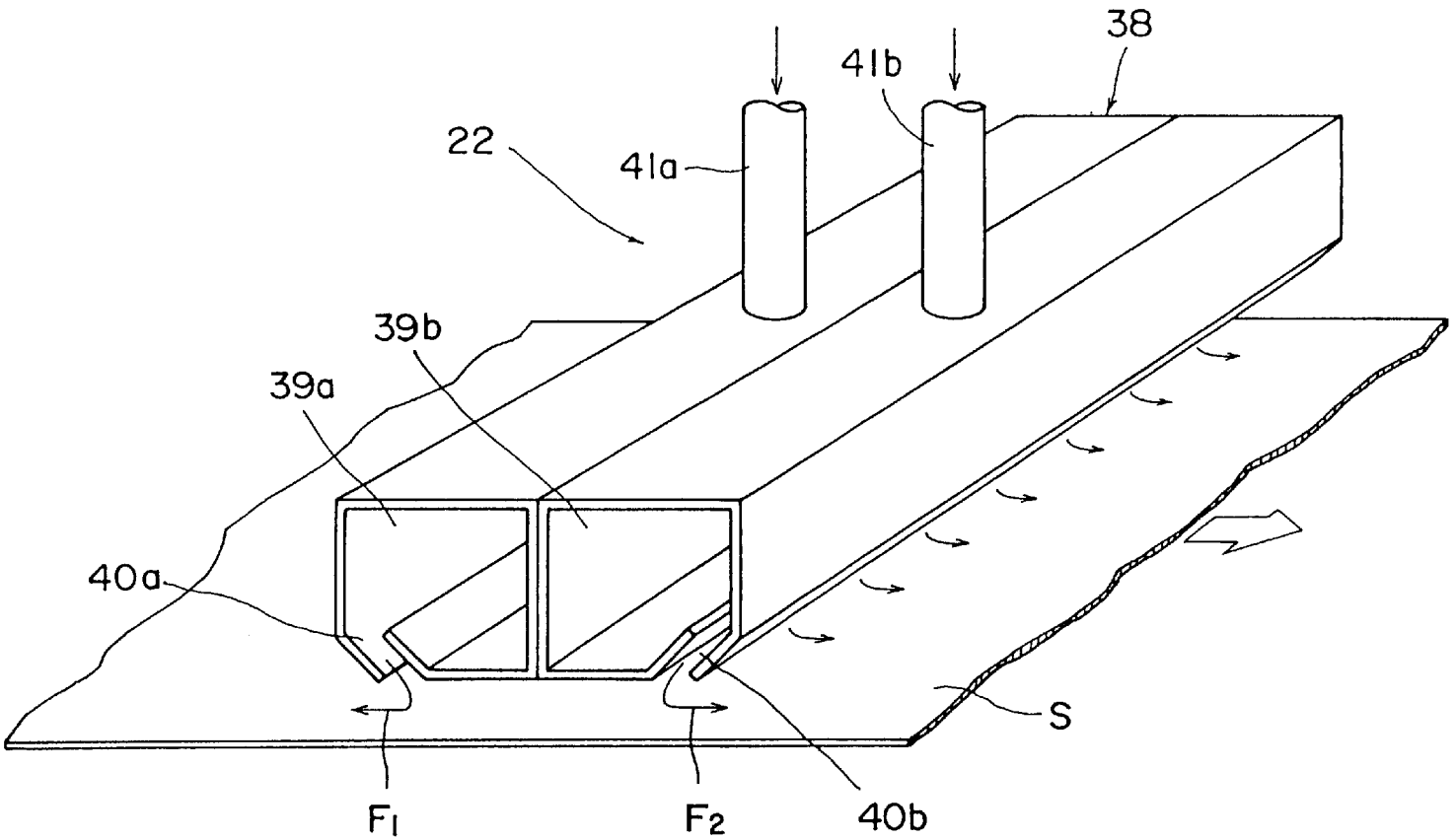
FIG. 3 is a perspective schematic view of a liquid seal.

As shown in FIGS. 1 and 3, in the liquid seal 22 provided at a junction between the first tank 13 and the second tank 14, a fixed skid 37 is attached to an upper end of the partition wall 12 at nearly the same height as the height of the respective skids 31*a* to 31*d*, 32*a* to 32*d*. On a lower surface of the lid 15, a cushion nozzle 38 for jetting the acid liquids $L_1$ and $L_2$ contained in the first tank 13 and the second tank 14 is provided opposite the fixed skid 37. This cushion nozzle 38 is composed of a jetting chamber 39*a* for the first tank 13 and a jetting chamber 39*b* for the second tank 14, and slit nozzles 40*a* and 40*b* extending obliquely therefrom, respectively. To the jetting chamber 39*a*, a supply pipe 41*a* from the first tank 13 is connected. On this supply pipe 41*a*, a liquid pump 42*a* and a flow control valve 43*a* are mounted. To kf the jetting chamber 39*b*, a supply pipe 41*b* from the second tank 13 is connected. On this supply pipe 41*b*, a liquid pump 42*b* and a flow control valve 43*b* are mounted. The liquid pumps 42*a*, 42*b* and the flow control valves 43*a*, 43*b* can be arbitrarily adjusted by a control device (not shown).

Figure 4:
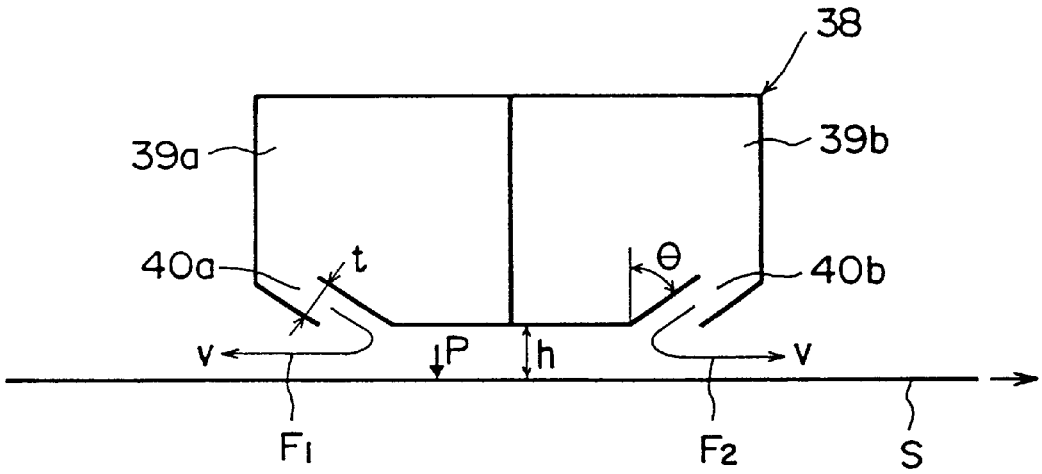
FIG. 4 is a schematic view showing the actions of the liquid seal.

In this case, as shown in FIG. 4, let the width of the slit nozzles 40*a*, 40*b* be t, the angle of inclination of the slit nozzles 40*a*, 40*b* be θ, the distance between the slit nozzles 40*a*, 40*b* and the strip steel plate S be h, the flow velocity of jets $F_1$, $F_2$ be v, and the density of the acid liquids $L_1$, $L_2$ be p. Then, a static pressure, P, which occurs is given by:

$$P = \frac{\rho v^2(1 + \sin\theta)}{h}$$

Thus, the strip steel plate S is guided by the aerial deflector roll 18 and the immersion deflector roll 19 of the inlet portion 16 into the acid liquid $L_1$ of the first tank 13, where the strip steel plate S travels, while being guided, between the plurality of immersion guide rolls 25*a* to 25*d* and the plurality of skids 31*a* to 31*d*. On this occasion, oxide scale formed on the surface of the strip steel plate S is washed with and removed by the acid liquid $L_1$. Then, the strip steel plate S is passed between the fixed skid 37 and the cushion nozzle 38 in the liquid seal 22, and led into the acid liquid $L_2$ of the second tank 14.

In the cushion nozzle 38 of the liquid seal 22, the acid liquid $L_1$ of the first tank 13 is guided into the jetting chamber 39*a* through the supply pipe 41*a*, and jetted from the slit nozzle 40*a*, by the action of the liquid pump 42*a*. Whereas the acid liquid $L_2$ of the second tank 14 is guided into the jetting chamber 39*b* through the supply pipe 41*b*, and jetted from the slit nozzle 40*b*, by the action of the liquid pump 42*b*. The jet $F_1$ from the slit nozzle 40*a* and the jet $F_2$ from the slit nozzle 40*b* collide with the surface of the strip steel plate S, and also collide with each other, thereby flowing toward the acid pickling tanks, which they belong to, without mixing with each other. That is, the jet $F_1$ flows toward the first tank 13, becoming the acid liquid $L_1$. On the other hand, the jet $F_2$ flows toward the second tank 14, becoming the acid liquid $L_2$. Thus, the jets $F_1$ and $F_2$ do not mix, and liquid sealing of the first tank 13 and the second tank 14 relative to each other can be performed, with the strip steel plate S being supported by the jets $F_1$, $F_2$ and the fixed skid 37.

The strip steel plate S, which has been guided into the acid liquid $L_2$ of the second tank 14 through the liquid seal 22, travels, while being guided, between the plurality of immersion guide rolls 26*a* to 26*d* and the plurality of skids 32*a* to 32*d*. On this occasion, the oxide scale formed on the surface of the strip steel plate S is washed with and removed by the acid liquid $L_2$. Then, the strip steel plate S is guided by the immersion deflector roll 21 and the aerial deflector roll 20 of the outlet portion 17 to the outside of the second tank 14.

According to the acid pickling device of the present embodiment, as described above, the liquid seal 22 is provided between the first tank 13 and the second tank 14 so as to be immersed in the acid liquid. This liquid seal 22 is composed of the fixed skid 37 and the cushion nozzle 38. Hence, the strip steel plate S can be supported in a straight form between the first tank 13 and the second tank 14, and a great bending stress does not act on the strip steel plate S. As a result, the tension of the strip steel plate S in the entire acid pickling device can be decreased, and an increase in the operating power can be prevented. Furthermore, the cushion nozzle 38 jets the acid liquids $L_1$ and $L_2$ of the first tank 13 and the second tank 14 toward the strip steel plate S, and the acid liquids $L_1$ and $L_2$ of the first tank 13 and the second tank 14 are circulated, becoming free from stagnation. Besides, no rolls are present between the first tank 13 and the second tank 14. Thus, roll maintenance becomes unnecessary, and the running cost is reduced.

According to the acid pickling device of the present embodiment, moreover, the covering portion 12*a* in the central part of the lid 12 enters the acid liquids $L_1$ and $L_2$ in the first tank 13 and the second tank 14, and lies below the liquid level of these acid liquids. As a result, most of the free surface of the acid liquids $L_1$ and $L_2$ in the acid pickling tank 11 is covered with the covering portion. Thus, the surface area of the acid liquids $L_1$ and $L_2$ in the first tank 13 and the second tank 14 becomes smaller than in the earlier technology. Hence, a loss of the acid due to evaporation is decreased to ensure the reliable washing and removal of the oxide scale on the strip steel plate S by acid pickling.

In addition, as stated above, the covering portion 12*a* of the lid 12 enters the acid liquid L in the first tank 13 and the second tank 14, thereby forcibly restraining the free surface of the acid liquids $L_1$ and $L_2$, so that the liquid level can be kept constant. Besides, the acid liquid communication holes 33*a* to 33*d*, 34*a* to 34*d*, through which the acid liquids $L_1$ and $L_2$ can flow, are formed in the support blocks 27*a* to 27*d*, 28*a* to 28*d*. In the bottom plates 29, 30, the acid liquid passages 35*a* to 35*c*, 36*a* to 36*c*, through which the acid liquids $L_1$, $L_2$ can flow, are formed. When the strip steel plate S travels, while being guided, between the immersion guide rolls 25*a* to 25*d*, 26*a* to 26*d* and the skids 31*a* to 31*d*, 32*a* to 32*d*, the acid liquids $L_1$ and $L_2$ follow the strip steel plate S as it moves. As a result, a downstream flow of the acid liquids $L_1$, $L_2$ in the traveling direction of the strip steel plate S occurs. However, the acid liquids $L_1$, $L_2$ do not wave, since their liquid level is restrained by the covering portion 15*a* of the lid 15. This flow of the acid liquids $L_1$, $L_2$ passes through the communication holes 33*a* to 33*d*, 34*a* to 34*d* and the acid liquid passages 35*a* to 35*c*, 36*a* to 36*c*, and circulates within the first tank 13 and the second tank 14. There is no stagnation of the acid liquids $L_1$, $L_2$, and the liquid pressure is released. Hence, it does not occur that the surface of the acid liquid $L_2$ beside the outlet portion 17 suddenly rises, causing overflow of the acid liquid $L_2$ to the outside. Moreover, the liquid pressure in the first tank 13 and the second tank 14 is released, and does not increase. Thus, the strength of the lid 15 can be reduced.

Opposite the plural immersion guide rolls 25*a* to 25*d*, 26*a* to 26*d* suspended from the lid 15, the plural skids 31*a* to 31*d*, 32*a* to 32*d* are fixed to the bottom plates 29, 30 on the plural support blocks 27*a* to 27*d*, 28*a* to 28*d* fixed to the bottom surface of the first tank 13 and the second tank 14. Thus, there is no need to suspend heavy materials from the lid 15, so that the rigidity of the lid 15 can be decreased, and it can be made light-weight.

Next, a second embodiment of the present invention will be described in detail by reference to the accompanying drawings. Members having the same functions as those explained in the aforementioned embodiment will be assigned the same numerals or symbols, and overlapping explanations will be omitted.

Figure 5:
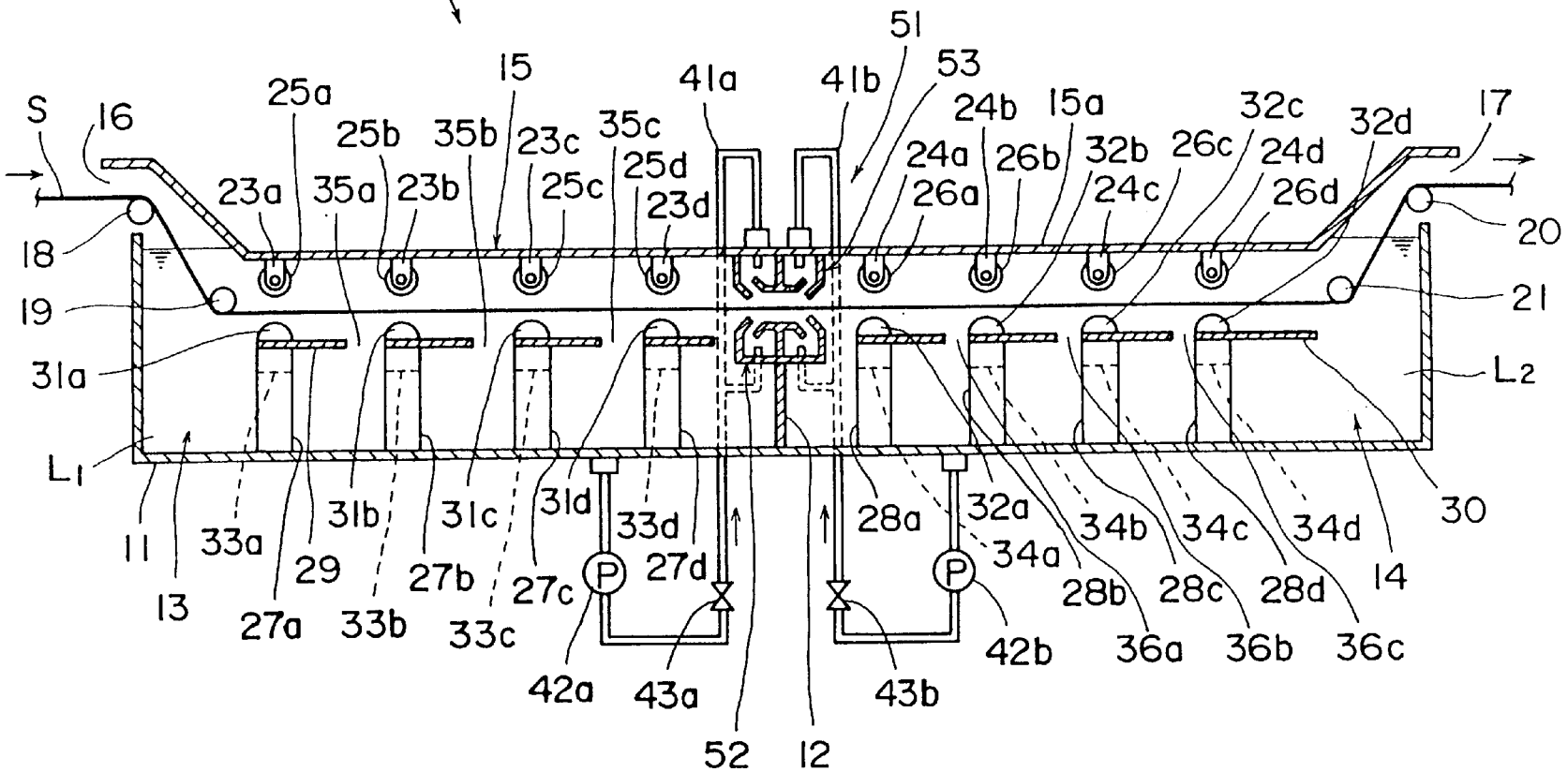
FIG. 5 is a schematic side view of an acid pickling device according to a second embodiment of the present invention.

In an acid pickling device of the present embodiment, as shown in FIG. 5, an acid pickling tank body 11 is partitioned with a partition wall 12 into a first tank 13 and a second tank 14, and the first tank 13 and the second tank 14 are filled with acid liquids $L_1$ and $L_2$, respectively, of different concentrations for acid pickling of a strip steel plate S. A lid 15 is attached to the top of the acid pickling tank body 11. Between the first tank 13 and the second tank 14, a liquid seal 51 is provided for inhibiting the mixing of the acid liquids $L_1$ and $L_2$. On a lower surface of a covering portion 15*a* of the lid 15, immersion guide rolls 25*a* to 25*d*, 26*a* to 26*d* are mounted which are immersed in the first tank 13 and the second tank 14. On a bottom surface of each of the first tank 13 and the second tank 14, a plurality of support blocks 27*a* to 27*d*, 28*a* to 28*d* are arranged parallel. To the top of the support blocks 27*a* to 27*d*, 28*a* to 28*d*, a plurality of skids 31*a* to 31*d*, 32*a* to 32*d* are fixed via bottom plates 29, 30.

In the liquid seal 51 provided at a junction between the first tank 13 and the second tank 14, a lower cushion nozzle 52 for jetting the acid liquids $L_1$ and $L_2$ contained in the first tank 13 and the second tank 14 is provided at an upper end of the partition wall 12, at nearly the same height as the height of the respective skids 31*a* to 31*d*, 32*a* to 32*d*. On a lower surface of the lid 15, an upper cushion nozzle 53 is provided opposite the lower cushion nozzle 52. To the cushion nozzles 52, 53, supply pipes 41*a*, 41*b* from the tanks 13, 14 are connected. On the supply pipes 41*a* and 41*b*, liquid pumps 42*a* and 42*b* and flow control valves 43*a* and 43*b* are mounted, respectively. The cushion nozzles 52, 53 are each the same in constitution as the cushion nozzle 38 of the first embodiment, and their detailed descriptions are omitted.

Thus, the strip steel plate S is guided from an inlet portion 16 into the acid liquid $L_1$ of the first tank 13, where the strip steel plate S travels, while being guided, between the immersion guide rolls 25*a* to 25*d* and the skids 31*a* to 31*d*. On this occasion, oxide scale formed on the surface of the strip steel plate S is washed with and removed by the acid liquid $L_1$. Then, the strip steel plate S is passed through the liquid seal 51, and led into the acid liquid $L_2$ of the second tank 14. In the liquid seal 51, the acid liquid $L_1$ of the first tank 13 is guided to the cushion nozzles 52, 53, for jetting, through the supply pipe 41*a* by the action of the liquid pump 42*a*. Whereas the acid liquid $L_2$ of the second tank 14 is guided to the cushion nozzles 52, 53, for jetting, through the supply pipe 41*b* by the action of the liquid pump 42*b*. Jets $F_1$ and $F_2$ from the cushion nozzles 52, 53 collide with the surface and back of the strip steel plate S, and also collide with each other, thereby flowing into the acid pickling tanks, which they belong to, without mixing with each other. Thus, liquid sealing of the first tank 13 and the second tank 14 relative to each other can be performed, with the strip steel plate S being supported by the jets $F_1$, $F_2$. Then, the strip steel plate S, which has been guided into the acid liquid $L_2$ of the second tank 14 through the liquid seal 51, travels, while being guided, between the immersion guide rolls 26*a* to 26*d* and the skids 32*a* to 32*d*. On this occasion, the oxide scale on the strip steel plate S is washed with and removed by the acid liquid $L_2$. Then, the strip steel plate S is delivered from an outlet portion 17.

Next, a third embodiment of the present invention will be described in detail by reference to the accompanying drawings.

Figure 6:
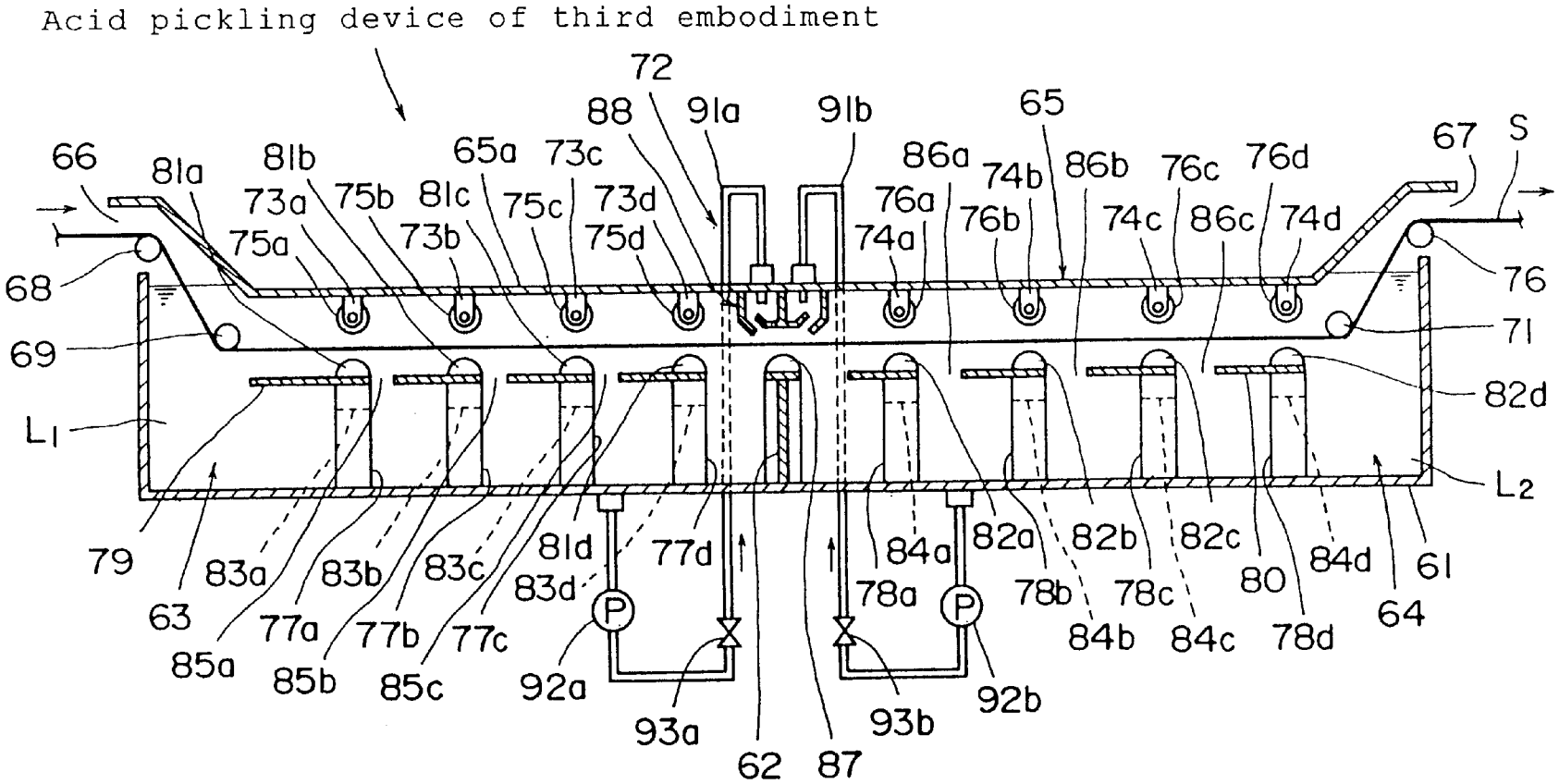
FIG. 6 is a schematic side view of an acid pickling device according to a third embodiment of the present invention.

In an acid pickling device of the present embodiment, as shown in FIG. 6, an acid pickling tank body 61 is partitioned with a partition wall 62 into a first tank 63 and a second tank 64. The first tank 63 and the second tank 64 are filled with acid liquids $L_1$ and $L_2$, respectively, of different concentrations for acid pickling of a strip steel plate S. A lid 65 is attached. to the top of the acid pickling tank body 61 to form an inlet portion 66 in the first tank 63, and an outlet portion 67 in the second tank 64. The lid 65 has a central part forming a covering portion 65*a*. The covering portion 65*a* enters the acid liquids $L_1$ and $L_2$ of the first tank 63 and the second tank 64, and lies below the liquid level of these acid liquids. Thus, most of the free surface of the acid liquids $L_1$ and $L_2$ of the first tank 63 and the second tank 64 is covered thereby. To the inlet portion 66, an aerial deflector roll 68 and an immersion deflector roll 69 are attached. To the outlet portion 67, an aerial deflector roll 70 and an immersion deflector roll 71 are attached. Between the first tank 63 and the second tank 64, a liquid seal 72 is provided for inhibiting the mixing of the acid liquids $L_1$ and $L_2$. Thus, the mixing of the acid liquids $L_1$ and $L_2$ is inhibited by the liquid seal 72.

On a lower surface of the covering portion 65*a* of the lid 65, immersion guide rolls 75*a* to 75*d*, 76*a* to 76*d*, which are immersed in the first tank 63 and the second tank 64, are rotatably mounted by bearing portions 73*a* to 73*d*, 74*a* to 74*d*. The immersion guide rolls 75*a* to 75*d*, 76*a* to 76*d* are arranged parallel, with predetermined spacing, along a direction of travel of the strip steel plate S. On a bottom surface of each of the first tank 63 and the second tank 64, a plurality of support blocks 77*a* to 77*d*, 78*a* to 78*d* are arranged parallel along the direction of travel of the strip steel plate S. To the top of the support blocks 77*a* to 77*d*, 78*a* to 78*d*, bottom plates 79, 80 are fixed so as to connect the support blocks 77*a* to 77*d*, 78*a* to 78*d* together. To an upper surface of the bottom plates 79, 80, a plurality of skids 81*a* to 81*d*,

82*a* to 82*d* are fixed at positions opposed to the immersion guide rolls 75*a* to 75*d*, 76*a* to 76*d*.

In the support blocks 77*a* to 77*d*, 78*a* to 78*d*, acid liquid communication holes 83*a* to 83*d*, 84*a* to 84*d*, through which the acid liquid L can flow, are formed. In the bottom plates 79, 80, acid liquid passages 85*a* to 85*c*, 86*a* to 86*c*, through which the acid liquids $L_1$, $L_2$ can flow, are formed between the adjacent two of the skids 81*a* to 81*d*, 82*a* to 82*d* downstream in the direction of transport of the strip steel plate S. These acid liquid passages 85*a* to 85*c*, 86*a* to 86*c* are each in a slit, circular, or rectangular shape.

In the aforementioned liquid seal 72, a fixed skid 87 is attached to an upper end of the partition wall 62. On a lower surface of the lid 65, a cushion nozzle 88 for jetting the acid liquids $L_1$ and $L_2$ contained in the first tank 63 and the second tank 64 is provided opposite the fixed skid 87. To this cushion nozzle 88, supply pipes 91*a* and 91*b* from the respective tanks 63 and 64 are connected. On the supply pipes 91*a* and 91*b*, liquid pumps 92*a* and 92*b* and flow control valves 93*a* and 93*b* are mounted, respectively. The cushion nozzle 88 is the same in constitution as the cushion nozzle 38 of the first embodiment, and its detailed explanation is omitted.

Thus, the strip steel plate S is guided by the aerial deflector roll 68 and the immersion deflector roll 69 of the inlet portion 66 into the acid liquid $L_1$ of the first tank 63, where the strip steel plate S travels, while being guided, between the plurality of immersion guide rolls 75*a* to 75*d* and the plurality of skids 81*a* to 81*d*. On this occasion, oxide scale formed on the surface of the strip steel plate S is washed with and removed by the acid liquid $L_1$. Then, the strip steel plate S is passed between the fixed skid 87 and the cushion nozzle 88 in the liquid seal 72, and led into the acid liquid $L_2$ of the second tank 64.

In the liquid seal 72, the acid liquids $L_1$ and $L_2$ of the tanks 63 and 64 are fed into the cushion nozzle 88 through the supply pipes 91*a* and 91*b* by the action of the liquid pumps 92*a* and 92*b*. Jets $F_1$ and $F_2$ from the cushion nozzle 88 collide with the surface of the strip steel plate S, and also collide with each other, thereby flowing into the acid pickling tanks, which they belong to, without mixing with each other. Thus, liquid sealing of the first tank 63 and the second tank 64 relative to each other can be performed, with the strip steel plate S being supported by the jets $F_1$, $F_2$ and the fixed skid 87.

The strip steel plate S, which has been guided into the acid liquid $L_2$ of the second tank 64 through the liquid seal 72, travels, while being guided, between the plurality of immersion guide rolls 76*a* to 76*d* and the plurality of skids 82*a* to 82*d*. On this occasion, the oxide scale formed on the surface of the strip steel plate S is washed with and removed by the acid liquid $L_2$. Then, the strip steel plate S is guided by the immersion deflector roll 71 and the aerial deflector roll 70 of the outlet portion 67 to the outside of the second tank 64.

According to the acid pickling device of the present embodiment, as described above, the liquid seal 72 is provided between the first tank 63 and the second tank 64 go as to be immersed in the acid liquid. This liquid seal 72 is composed of the fixed skid 87 and the cushion nozzle 88. Hence, the strip steel plate S can be supported in a straight form between the first tank 63 and the second tank 64, and a great bending stress does not act on the strip steel plate S. As a result, the tension of the strip steel plate S in the entire acid pickling device can be decreased, and an increase in the operating power can be prevented. Furthermore, when the strip steel plate S travels, while being guided, between the immersion guide rolls 75*a* to 75*d*, 76*a* to 76*d* and the skids 81*a* to 81*d*, 82*a* to 82*d*, a downstream flow of each of the acid liquids $L_1$, $L_2$ in the traveling direction of the strip steel plate S occurs as the strip steel plate S moves. However, this flow of the acid liquids $L_1$, $L_2$ moves downward through the acid liquid passages 85*a* to 85*c*, 86*a* to 86*c*, further passes through the communication holes 83*a* to 83*d*, 84*a* to 84*d*, and is returned upstream in the direction of transport of the strip steel plate S. The acid liquid passages 85*a* to 85*c*, 86*a* to 86*c* are located at positions just behind the site of passage of the strip steel plate S between the immersion guide rolls 75*a* to 75*d*, 76*a* to 76*d* and the skids 81*a* to 81*d*, 82*a* to 82*d*. Thus, agitation of the acid liquid L is promoted, and the acid liquid L is circulated in the acid pickling tank 31, so that there is no stagnation of the acid liquid L.

Next, a fourth embodiment of the present invention will be described in detail by reference to the accompanying drawings. Members having the same functions as those explained in the aforementioned embodiment will be assigned the same numerals or symbols, and overlapping explanations will be omitted.

Figure 7:
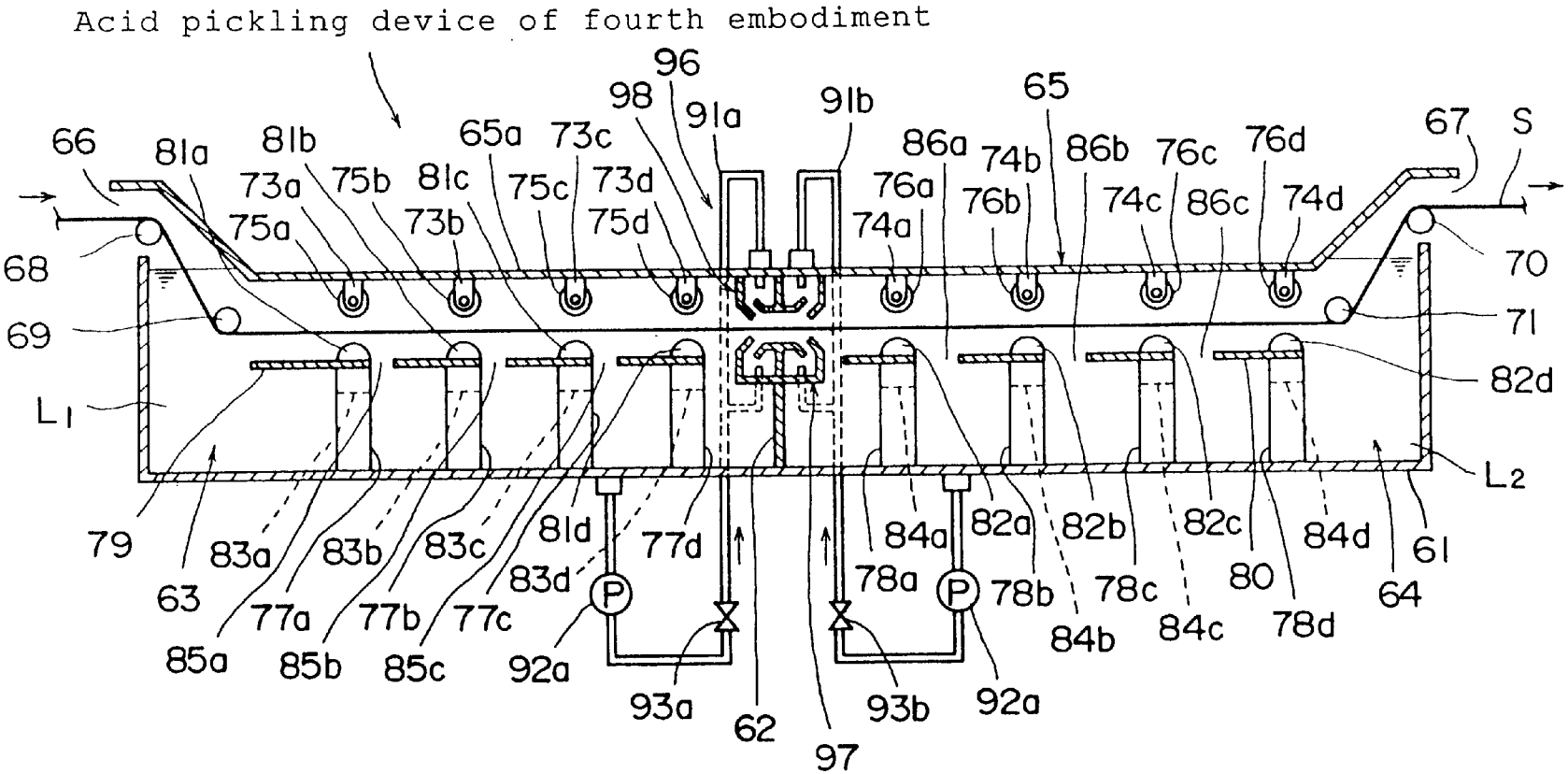
FIG. 7 is a schematic side view of an acid pickling device according to a fourth embodiment of the present invention.
Figure 8:
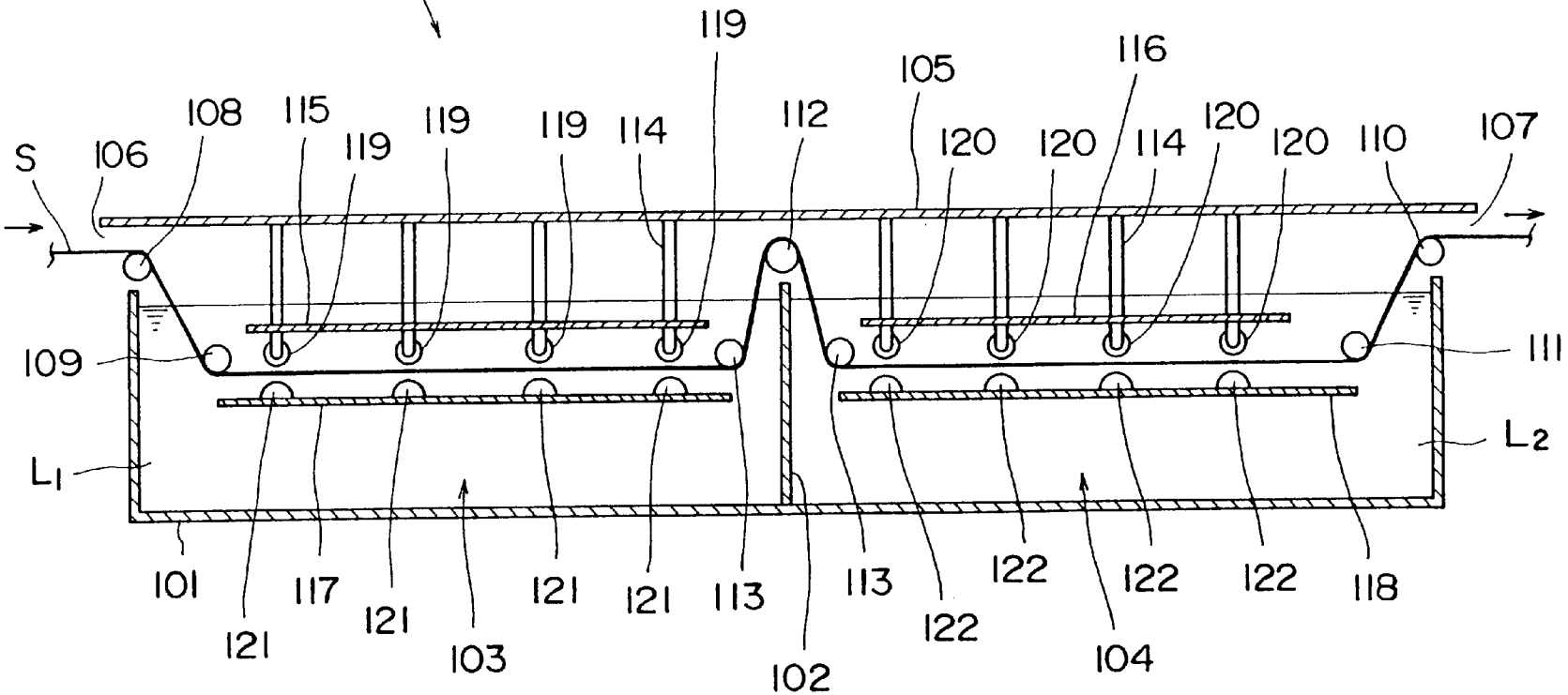
FIG. 8 is a schematic side view of a conventional acid pickling device.

In an acid pickling device of the present embodiment, as shown in FIG. 7, an acid pickling tank body 61 is partitioned with a partition wall 62 into a first tank 63 and a second tank 64. The first tank 63 and the second tank 64 are filled with acid liquids $L_1$ and $L_2$, respectively, of different concentrations for acid pickling of a strip steel plate S. A lid 65 is attached to the top of the acid pickling tank body 61. Between the first tank 63 and the second tank 64, a liquid seal 96 is provided for inhibiting the mixing of the acid liquids $L_1$ and $L_2$. On a lower surface of a covering portion 65*a* of the lid 65, immersion guide rolls 75*a* to 75*d*, 76*a* to 76*d* are mounted which are immersed in the first tank 63 and the second tank 64. On a bottom surface of each of the first tank 63 and the second tank 64, a plurality of support blocks 77*a* to 77*d*, 78*a* to 78*d* are arranged parallel. To the top of the support blocks 77*a* to 77*d*, 78*a* to 78*d*, a plurality of skids 81*a* to 81*d*, 82*a* to 82*d* are fixed via bottom plates 79, 80.

In the liquid seal 96 provided at a junction between the first tank 63 and the second tank 64, a lower cushion nozzle 97 for jetting the acid liquids $L_1$ and $L_2$ contained in the first tank 63 and the second tank 64 is provided at an upper end of the partition wall 62. On a lower surface of the lid 65, an upper cushion nozzle 98 is provided. The cushion nozzles 97, 98 are each the same in constitution as the cushion nozzle 51 of the second embodiment, and their detailed descriptions are omitted.

Thus, the strip steel plate S is guided from an inlet portion 66 into the acid liquid $L_1$ of the first tank 63, where the strip steel plate S travels, while being guided, between the immersion guide rolls 75*a* to 75*d* and the skids 81*a* to 81*d*. On this occasion, oxide scale formed on the surface of the strip steel plate S is washed with and removed by the acid liquid $L_1$. Then, the strip steel plate S is passed through the liquid seal 96, and led into the acid liquid $L_2$ of the second tank 64. At this time, the acid liquids $L_1$, $L_2$ of the tanks 63, 64 are guided to the cushion nozzles 97, 98, for jetting, through the supply pipes 91*a*, 91*b* by the action of the liquid pumps 92*a*, 92*b*. Jets $F_1$ and $F_2$ from the cushion nozzles 97, 98 collide with the surface and back of the strip steel plate S. and also collide with each other, thereby flowing into the acid pickling tanks, which they belong to, without mixing with each other. Thus, liquid sealing of the first tank 63 and the second tank 64 relative to each other can be performed, with the strip steel plate S being supported by the jets $F_1$, $F_2$. Then, the strip steel plate S, which has been guided into the acid liquid $L_2$ of the second tank 64 through the liquid seal 96, travels, while being guided, between the immersion guide rolls 76*a* to 76*d* and the skids 82*a* to 82*d*. On this occasion, the oxide scale on the strip steel plate S is washed with and removed by the acid liquid $L_2$. Then, the strip steel plate S is delivered from an outlet portion 67.

In the foregoing embodiments, the acid pickling tank body 11 was partitioned with the partition wall 12 into the first tank 13 and the second tank 14. However, it is permissible to form the first tank 13 and the second tank 14 separately, connect them together, and use their side walls as partition walls. Alternatively, the interior of the acid pickling tank body 11 may be partitioned into 3 or more tanks. In the embodiments, the central part of the lid 15 was depressed downward to form the covering portion 12*a*, and the immersion guide rolls 25*a* to 25*d*, 26*a* to 26*d* were mounted on the covering portion 12*a*. However, as in the earlier technology, it is permissible to suspend a ceiling plate and a bottom plate from a lower surface of a box-shaped lid, and provide the immersion guide rolls 25*a* to 25*d*, 26*a* to 26*d* and the skids 27*a* to 27*d*, 28*a* to 28*d* on these plates. Nor are the numbers of these members restricted to those stated in the embodiments.

INDUSTRIAL APPLICABILITY

As described above, the acid pickling device of the present invention immerses a strip plate in an acid pickling tank to wash and remove oxide scale, formed on the surface of the strip plate, by acid pickling. This device is preferred for use in a surface treating device for treating a continuously traveling strip plate at a high speed.

What is claimed is:

1. An acid pickling device for acid pickling a strip plate by causing the strip plate to travel in an acid pickling tank filled with an acid liquid while guiding the strip plate by an immersion guide roll and a skid, wherein two or more of the acid pickling tanks are adjacent to each other via a border site, and a liquid seal is provided at the border site, said liquid seal having a cushion nozzle for jetting the acid liquid in the acid pickling tanks toward a surface of the strip plate traveling in the acid pickling tanks.

2. The acid pickling device of claim 1, wherein at the border site, a partition wall is provided below the strip plate traveling in the acid pickling tanks; a fixed skid is provided on top of the partition wall at nearly the same height as the height of the skid; and the cushion nozzle is provided above the strip plate traveling in the acid pickling tanks.

3. The acid pickling device of claim 1, wherein at the border site, a partition wall is provided below the strip plate traveling in the acid pickling tanks; a lower cushion nozzle is provided on top of the partition wall; and an upper cushion nozzle is provided above the strip plate traveling in the acid pickling tanks.

4. The acid pickling device of claim 1, wherein the cushion nozzle has a first jetting nozzle for jetting the acid liquid in one of the adjacent acid pickling tanks, and a second jetting nozzle for jetting the acid liquid in the other acid pickling tank.

5. The acid pickling device of claim 4, wherein the first jetting nozzle and the second jetting nozzle are located in directions in which a first jet of the acid liquid and a second jet of the acid liquid jetted from the jetting nozzles collide with each other.

6. The acid pickling device of claim 1, wherein the cushion nozzle is provided at nearly the same height as the height of the immersion guide roll or the skid.

7. The acid pickling device of claim 1, wherein an acid pickling tank lid for covering the top of the acid pickling tanks is disposed such that a central part of the lid is positioned below the liquid level of the acid liquid in the acid pickling tanks to cover a free surface of the acid liquid.

8. The acid pickling device of claim 7, wherein the acid pickling tank lid is provided with the immersion guide roll and the cushion nozzle, and the skid is provided on a support block installed at a bottom of the acid pickling tank.

9. The acid pickling device of claim 7, wherein the acid pickling tank lid is provided with the immersion guide roll and an upper cushion nozzle, and the skid and a lower cushion nozzle are provided on a support block installed at a bottom of the acid pickling tank.

10. The acid pickling device of claim 1, wherein supply pipes from the respective acid pickling tanks are connected to the cushion nozzle, and a liquid pump and a flow control valve are mounted on each of the supply pipes.

* * * * *